US006173667B1

(12) United States Patent
Muessig et al.

(10) Patent No.: US 6,173,667 B1
(45) Date of Patent: Jan. 16, 2001

(54) METHOD OF PRODUCING A FABRIC COVER

(75) Inventors: Karl Muessig, Bad Koenigshofen; Hans Ziegler, Grossbardorf, both of (DE)

(73) Assignee: Texpa Maschinenbau GmbH & co. (DE)

( * ) Notice: Under 35 U.S.C. 154(b), the term of this patent shall be extended for 0 days.

(21) Appl. No.: 09/275,177

(22) Filed: Mar. 24, 1999

(30) Foreign Application Priority Data

Mar. 31, 1998 (DE) ..... 198 14 343

(51) Int. Cl.[7] ..... D05B 97/00; A47G 9/00
(52) U.S. Cl. ..... 112/475.06; 112/475.08
(58) Field of Search ..... 112/475.06, 470.01, 112/470.05, 470.06, 470.07, 470.12, 470.13, 470.16, 475.08; 5/636, 640, 490

(56) References Cited

U.S. PATENT DOCUMENTS 3,654,015 * 4/1972 Purcell et al. ..... 5/490 X
4,193,152 3/1980 Seibold, Jr. .
4,621,585 11/1986 Ball et al. .
5,084,928 * 2/1992 Skillington ..... 5/490
5,226,378 * 7/1993 Suzuki et al. ..... 112/470.16 X
5,566,410 * 10/1996 Schaechter ..... 5/490
5,802,644 * 9/1998 Scheurer ..... 5/640

* cited by examiner

*Primary Examiner*—Peter Nerbun
(74) *Attorney, Agent, or Firm*—McGlew and Tuttle, P.C.

(57) ABSTRACT

A method of producing fabric covers (19) is disclosed, in particular duvet covers or pillow cases, in which a length of fabric (7) with two longitudinal edges (10, 11) and two transverse edges (8, 9) is laid out flat, the opposing parts (14, 15) of a hook-and-loop tape then being fixed respectively to the two transverse edges (8, 9) at least in strips. The two transverse edges (8, 9) are then brought to lie against one another, the opposing parts (14, 15) of the hook-and-loop tape being aligned, and the superimposed areas of the two longitudinal edges (10, 12) are sewn together by means of ornamental seams (17, 18).

11 Claims, 2 Drawing Sheets

METHOD OF PRODUCING A FABRIC COVER

FIELD OF THE INVENTION

The invention relates to a method of producing a fabric cover, in particular of producing a duvet cover and/or pillow case or other fabric sleeves, from a substantially rectangular or square length of fabric with two longitudinal edges and two transverse edges.

The invention further relates to an installation for carrying out the method of producing a fabric cover, in particular a duvet cover or pillow case, from a substantially rectangular or square length of fabric with two longitudinal edges and two transverse edges.

BACKGROUND OF THE INVENTION

Many methods of producing duvet covers are known from the prior art. In one of the most commonly used methods, firstly a substantially rectangular length of fabric is cut from a continuous roll. This length of fabric comprises two longitudinal edges and two transverse edges, wherein the length of the longitudinal edges is substantially double the length of the longitudinal edges of the fabric cover to be produced. Once the transverse edges have been hemmed, the length of fabric is folded to form a folded edge, in such a way that the two opposing transverse edges come to lie against one another, thereby forming the fabric cover, wherein the fabric cover is inside out, i.e. the side which will ultimately be on the inside is on the outside. In this position, the superimposed areas of the two longitudinal edges are sewn together. Buttons are then fixed to one hem and button holes matching the buttons are made in the opposing hem. Once finished, the fabric cover is reversed such that the side hitherto on the inside is turned to the outside and the seams at the longitudinal edges find themselves on the inside remote from the user. Finally, the fabric cover is folded and packaged.

A particular disadvantage of the above-described manufacturing method is the large number of stages involved, in particular in connection with the production of the button holes, sewing-on of the button fasteners and reversing of the fabric cover. In addition, the individual manufacturing stages are as a rule difficult to automate, making this known manufacturing method personnel-intensive, time-consuming and thus expensive.

SUMMARY AND OBJECTS OF THE INVENTION

The primary object of the present invention is to propose a method of producing fabric covers which allows fabric covers to be produced simply, quickly and comparatively economically.

The method according to the invention for producing a fabric cover from a substantially rectangular or square length of fabric with two longitudinal edges and two transverse edges comprises the following stages:

First of all, at least one strip of hook-and-loop tape is attached, in particular, sewn, to the two opposing transverse edges of the length of fabric in such a way that the respective functionally complementary parts each lie substantially opposite each other with respect to the central transverse axis of the length of fabric. The hook and-loop tape may be attached fundamentally in any desired manner continuously over the entire transverse edge or only in strips.

The length of fabric is then folded about the central transverse axis, which becomes a fold axis, in such a way that the two opposing transverse edges come to lie against one another, the parts of the hook-and-loop tape simultaneously forming the hook-and-loop fastening. Thus, the length of fabric takes on the external form of the fabric cover to be produced, wherein folding may preferably be effected such that, in the case of fabrics with two different sides, for example printed fabrics, the side which will ultimately be the outside of the fabric cover is already on the outside.

To secure the layers of fabric in the desired form, the superimposed areas of each longitudinal edge are sewn together by means of an ornamental seam, whereby a fabric cover is formed which is closed on three sides and may be fastened and opened on one side by a hook-and-loop fastener. The ornamental seam may be produced using, for example, tight whipstitching or a pearl-edged seam. Since the two longitudinal edges are sewn together with an ornamental seam, reversing of the fabric cover after sewing together may be dispensed with. The ornamental seam remains visible on the outside of the fabric cover and may be used as part of the design, for example by using a contrasting color or the like.

Since, in the method according to the invention, the sewing-on of buttons, making of button holes and reversing of the fabric cover are dispensed with, the production of fabric covers by this method involves fewer stages and may be extensively automated. By saving on personnel and achieving shorter throughput times, the manufacturing costs may be reduced significantly. In addition, an extra design element is provided by using an ornamental seam.

According to an exemplary embodiment of the invention, the transverse edges may be hemmed before or at the same time as the strip of hook-and-loop tape is sewn on. According to a particularly preferred variant of the method, the hems at the transverse edges are sewn substantially at the same time as the functionally complementary parts of the hook-and-loop tape are sewn on. At the same time as a sewing machine travels along the transverse edge of the length of fabric or, conversely, the respective transverse edge is guided through a sewing machine, in order to sew the hem, one part of a hook-and-loop tape or of a hook-and-loop tape strip is supplied continuously or in strips and sewn together with the hem. By operating in this way, it is possible to omit one stage, since the hem and hook-and-loop tape are fixed to the length of fabric in one operation.

According to another embodiment of the method according to the invention, a separating component, for example in the form of a separator plate, may initially be introduced, during folding of the length of fabric about the central transverse axis, between the functionally complementary parts of the hook-and-loop tape coming to lie against one another, in order to prevent the hook-and-loop tape parts from hooking together undesirably early. In this way, the superimposed lengths of fabric may be adjusted so as to fit together accurately. Once correct alignment has been achieved, the separating component may be removed and the hook-and-loop fastening may thereby be produced.

In the simplest form of the method according to the invention, the hook-and-loop fastener is arranged directly on one of the outer edges of the fabric cover. This may be disadvantageous if the fabric cover cannot be closed by continuous hook-and-loop tape, since the corners of duvets and pillows tend to stick out of fabric covers which cannot be fully closed it is therefore advantageous for the length of fabric to be folded over once in the area of a transverse edge, before the opposing parts of the hook-and-loop tape are laid one against the other to form the hook-and-loop fastening and the length of fabric is secured to form the cover by the sewing of seams along the longitudinal edges. The folded area of the transverse edge forms a pocket in which the corners of a duvet or pillow may be accommodated so that they are no longer able to project from the fabric cover.

Once the method according to the invention has been carried out, the fabric covers may be folded in a manner known per se in a folding device, to enable subsequent packaging thereof. The folding device may be connected downstream of an installation consisting of one or more devices for carrying out the method according to the invention or be incorporated in this installation or device.

The ornamental seam is preferably produced using a bulky thread, in particular of synthetic fiber, for example polyester fiber. The bulky structure of such threads allows them to effect optimum coverage of the fabric layers sewn together in the area of the seam.

In order reliably to prevent fraying of the seam ends, seams must be finished off neatly. This may be achieved, for example, by deliberate sewing-over of the seam ends. A seam may be finished particularly economically by closing or securing the seam ends of the ornamental seam by heat sealing the thread, in particular by using ultrasonic sealing. When the seam end is reached, an ultrasonic sealing tool is set in position in the area of the seam and the fusible thread is severed by the action of the heat. In addition, the thread is melted slightly in the area of the seam ends under the influence of the heat and fraying of the seams is thus reliably prevented.

To fix the folded length of fabric in the shape intended for the fabric cover to be produced, it is sufficient for an ornamental seam to extend along only the two longitudinal edges and the fabric cover thereby to be closed at the sides. If the ornamental seam is used as part of the design, for example by using a colored thread, the ornamental seam should extend substantially without interruption along the sewn-together areas of the two longitudinal edges and the folded transverse edge of the fabric cover. The fabric cover thus produced is then framed on three sides by the ornamental seam. It goes without saying that ornamental seams may also be provided at the transverse edges which form the opening of the fabric cover. In this instance, the fabric cover is framed by the ornamental seam on all sides.

An installation for producing fabric covers and comprising at least three work stations is also proposed. In the first work station there is provided a sewing device for fastening the functionally complementary parts of a hook-and-loop tape to the two transverse edges of the length of fabric. In the second work station, the length of fabric is folded about the central transverse axis in such a way that the two transverse edges come to lie against one another. Finally, the third work station comprises another sewing device for sewing up the longitudinal edges with ornamental seams. The work stations for carrying out the method according to the invention may take the form of separate devices arranged one after the other. However, it is in principle also just as feasible for the work stations to be incorporated altogether or in groups in a single installation.

It is in the nature of hook-and-loop tape to hook together as soon as the opposing hook-and-loop tape parts are brought together, such that the two hook-and-loop tape parts no longer move relative to one another or are capable of adjustment. In order to be able to align the two transverse edges neatly when the length of fabric is folded together, a movable separating device, for example a movable separator plate, is preferably provided in the second work station. Before the two transverse edges are laid together and the opposing parts of the hook-and-loop tape are aligned, this separating device may be arranged between the opposing transverse edges to prevent hooking together of the hook-and-loop tape. After optimum alignment of the two transverse edges relative to one another, the separating device may be removed from between the opposing parts of the hook-and-loop tape, whereby the hook-and-loop fastener is closed and the two transverse edges are fixed together.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENT

Figure 1:
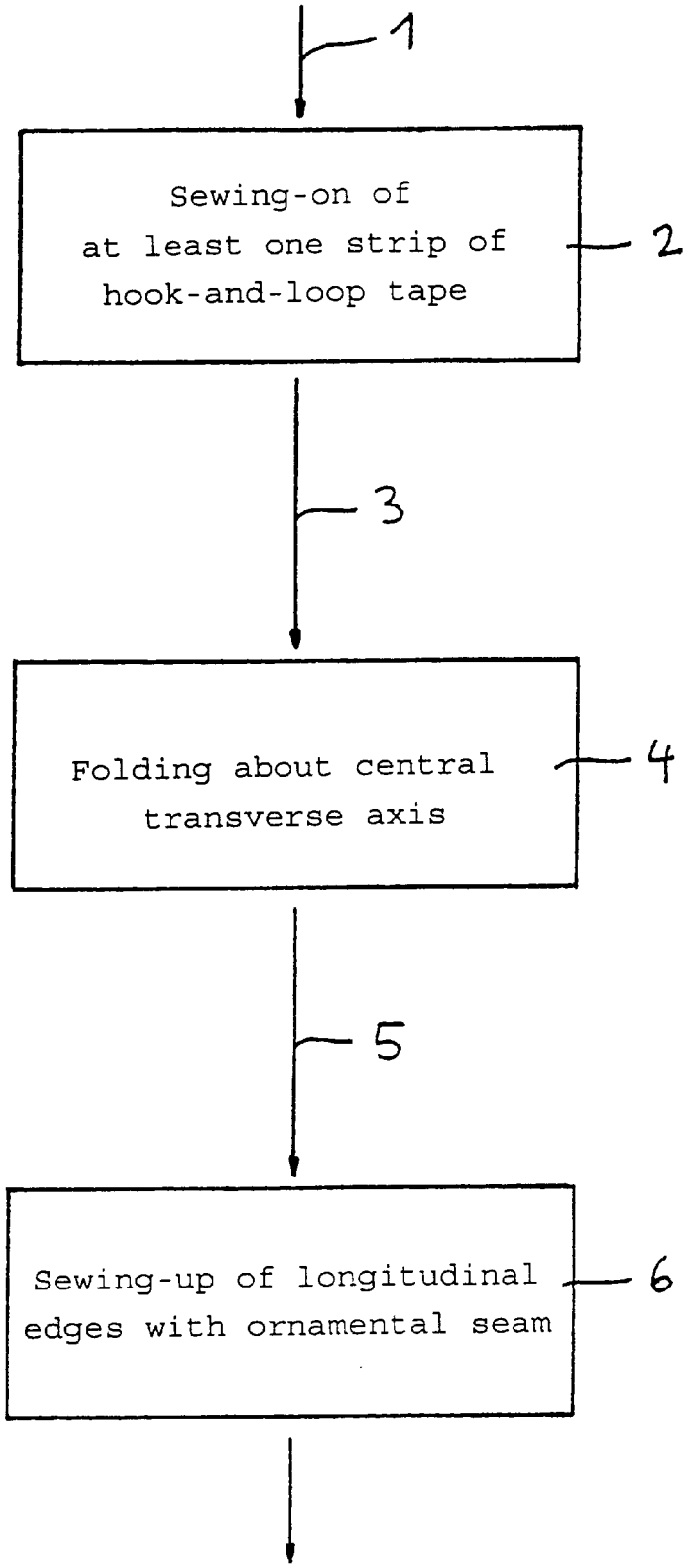
FIG. 1 is a schematic block diagram view of the method according to the invention.

Referring to the drawings in particular, FIG. 1 comprises a schematic block diagram of the method according to the invention for producing a fabric cover. In a first method stage 2, at least one strip of hook-and-loop tape is sewn to the opposing transverse edges of a length of fabric in such a way that the functionally complementary parts of the hook-and-loop tape are opposite each other with respect to the central transverse axis.

The length of fabric is then folded about its central transverse axis in method stage 4, such that the two transverse edges come to lie against one another, wherein at the same time the hook-and-loop fastener is closed and the transverse edges are thereby fixed together.

The two longitudinal edges are then sewn together in a method stage 6 using an ornamental seam, such that a fabric cover is obtained which is closed on three sides and may be fastened and opened on one side.

After passing through method stage 6, the finished fabric cover is folded and packaged. The provision of additional operating personnel may be avoided by using an automatic folding installation, which adjoins an installation for carrying out the method according to the invention.

Figure 2:
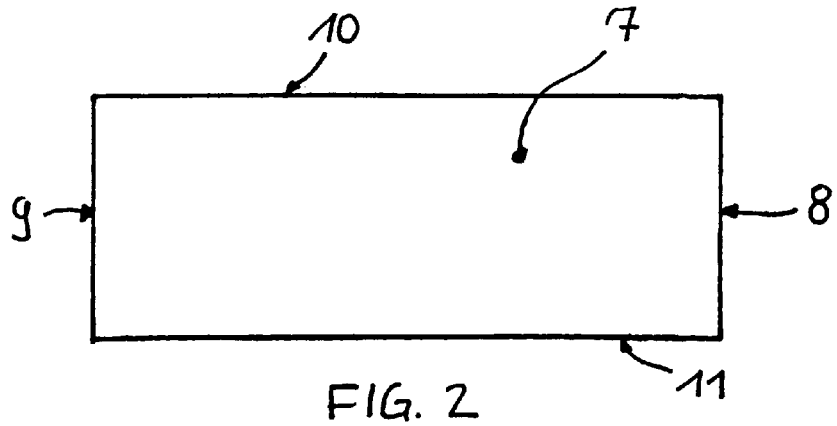
FIG. 2 is a view from above of a length of fabric in the unworked state.

FIG. 2 shows a length of fabric 7, which is to be processed to form a fabric cover and which has been cut from a continuous roll (not shown).

The width of the length of fabric and thus the length of the transverse edges 8 and 9 corresponds substantially to the width of the fabric cover to be produced; the length of the longitudinal edges 10 and 11 is approximately double the length of the fabric cover to be produced.

Figure 3:
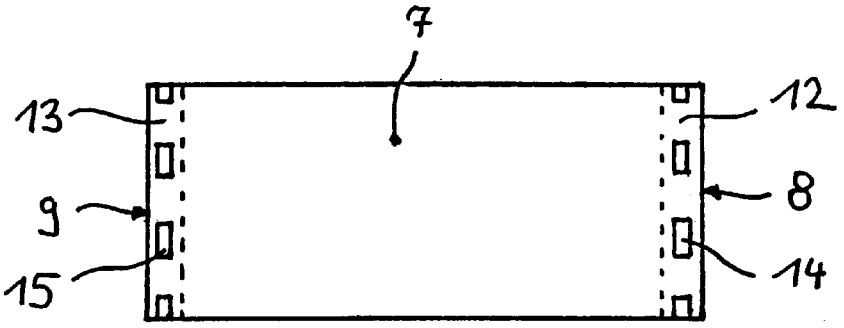
FIG. 3 is a view from above of the length of fabric of FIG. 2 after it has passed through the first stage of the method.

FIG. 3 shows the length of fabric 7 after it has passed through the first method stage 2. The transverse edges 8 and 9 are each hemmed, as indicated by the broken line. At the same time as the hems 12 and 13 are being produced, the functionally complementary parts 14 and 15 of the hook-and-loop tape are sewn in strips to the length of fabric 7 in mutually corresponding positions.

Figure 4:
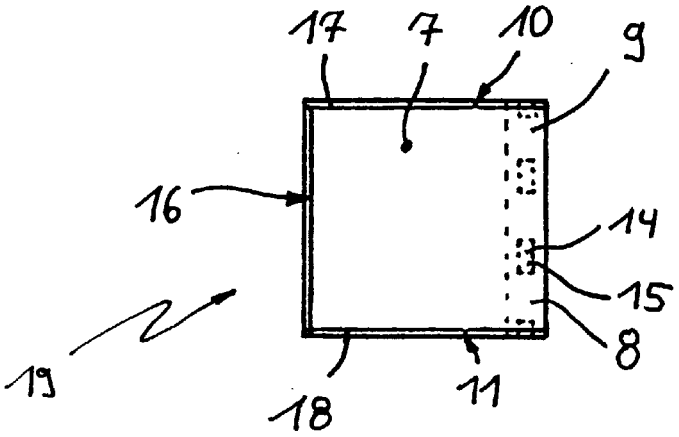
FIG. 4 is a view from above of the length of fabric according to FIG. 3 after it has passed through the third work station.

FIG. 4 shows the length of fabric 7 after it has passed through the second and third method -stages 4 and 6. The length of fabric 7 is folded along the central transverse axis or fold edge 16 in such a way that the transverse edges 8 and 9 of the length of fabric come to lie against one another, wherein at the same time the parts 14 and 15 of the hook-and-loop tape hook together to form a hook-and-loop fastening. The superimposed areas of the longitudinal edges 10 and 11 are sewn together by means of the ornamental seams 17 and 18. As indicated only schematically, an ornamental seam 19 is provided in the area of the fold edge 16, whereby the ornamental seam provides a frame around three sides of the fabric cover 19 produced from the length of fabric 7.

Figure 5:
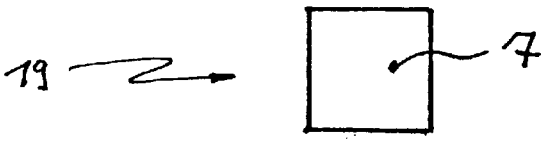
FIG. 5 is a view from above of the length of fabric according to FIG. 4 after it has been folded ready for packaging.

FIG. 5 shows the fabric cover 19 in the folded state achieved after passage through an automatic folding device (not shown).

While specific embodiments of the invention have been shown and described in detail to illustrate the application of the principles of the invention, it will be understood that the invention may be embodied otherwise without departing from such principles.

What is claimed is:

1. A method of producing a fabric cover, duvet cover and/or pillow case or other fabric sleeves, from a substantially rectangular or square length of fabric with two longitudinal edges and two transverse edges, the method comprising the steps of:

sewing at least one strip of hook-and-loop tape to the opposing transverse edges of the length of fabric in such a way that respective functionally complementary parts of the hook-and-loop tape lie substantially opposite each other with respect to the central transverse axis of the length of fabric;

folding the length of fabric substantially about the central transverse axis, in such a way that the two opposing transverse edges come to lie against one another, the parts of the hook-and-loop tape simultaneously forming a hook-and-loop fastening; and sewing together the superimposed areas of each longitudinal edge by means of an ornamental seam which substantially encompasses each longitudinal edge, whereby a fabric cover is formed which is closed on three sides and may be fastened and opened on one side by the hook-and-loop fastener.

2. The method according to claim 1, wherein folding is effected in such a way that the side which will ultimately be the outside of the fabric cover is on the outside.

3. The method according to claim 1, wherein the transverse edges are hemmed one of before and at the same time as the strip of hook-and-loop tape is sewn on.

4. The method according to claim 2, wherein the transverse edges are hemmed one of before and at the same time as the strip of hook-and-loop tape is sewn on.

5. A method according to any one of claim 3, wherein the length of fabric is folded inwards in the area of at least one of the transverse edges and is sewn together substantially at the same time as the strip of hook-and-loop tape is sewn on.

6. The method according to claim 1, wherein when the length of fabric is folded about the central transverse axis, a separating component is initially introduced, between the functionally complementary parts of the hook-and-loop tape coming to lie against one another, in order to prevent undesirable hooking together of the hook-and-loop tape parts before they have been correctly aligned.

7. The method according to claim 2, wherein when the length of fabric is folded about the central transverse axis, a separating component is initially introduced, between the functionally complementary parts of the hook-and-loop tape coming to lie against one another, in order to prevent undesirable hooking together of the hook-and-loop tape parts before they have been correctly aligned.

8. The method according to claim 3, wherein when the length of fabric is folded about the central transverse axis, a separating component is initially introduced, between the functionally complementary parts of the hook-and-loop tape coming to lie against one another, in order to prevent undesirable hooking together of the hook-and-loop tape parts before they have been correctly aligned.

9. The method according to claim 1, wherein a bulky thread comprising a synthetic fiber material, is used to produce the ornamental seams.

10. The method according to claim 1, wherein seam ends of the ornamental seams are closed or secured by heat-sealing of the thread.

11. The method according to claim 1, wherein seam ends of the ornamental seams are closed or secured by ultrasonic sealing.

* * * * *